United States Patent [19]

Reichert et al.

[11] Patent Number: 4,476,940

[45] Date of Patent: Oct. 16, 1984

[54] PORTABLE DRILLING APPARATUS

[75] Inventors: Ronald F. Reichert, Orem; Steven K. Kruger, Salt Lake City; John W. Rhodes, Provo, all of Utah

[73] Assignee: PDR Manufacturing Corporation, Orem, Utah

[21] Appl. No.: 371,592

[22] Filed: Apr. 26, 1982

[51] Int. Cl.[3] ..... E21B 7/12

[52] U.S. Cl. ..... 173/37; 173/160

[58] Field of Search ..... 173/21, 22, 23, 27, 173/28, 29, 31, 37, 147, 160, 162; 212/175, 178; 254/290, 291, 292, 340, 382

[56] References Cited

U.S. PATENT DOCUMENTS

| | | | |
|---|---|---|---|
| 3,047,080 | 7/1962 | Gunther, Jr. | 173/27 |
| 3,506,075 | 4/1970 | Attebo | 173/23 |
| 3,533,478 | 10/1970 | Tissier | 173/160 |
| 3,809,344 | 5/1974 | Kolderup et al. | 173/22 |
| 3,977,479 | 8/1976 | Sainsbury | 173/22 |
| 4,192,393 | 3/1980 | Womack et al. | 173/160 |
| 4,296,821 | 10/1981 | Larson | 173/29 |

*Primary Examiner*—Frank T. Yost
*Assistant Examiner*—Hien H. Phan
*Attorney, Agent, or Firm*—Thorpe, North & Western

[57] ABSTRACT

A lightweight portable drilling apparatus capable of being assembled and disassembled for lifting and moving by helicopter. The apparatus includes a center vertically-oriented drilling tower equipped with a rotary drilling assembly, and having a base supported by a plurality of adjustable leveling legs. Also included is a first module pivotally coupled to one side of the tower base and supported by a flexible tether attached to the module and the drilling tower near the top thereof, and a second module pivotally coupled to the other side of the base of the tower and supported by a flexible tether also attached to the drilling tower near the top thereof and to the second module. Each module includes either a power source, such as a diesel engine, or auxiliary power equipment for supplying power to operate the drilling assembly.

17 Claims, 6 Drawing Figures

PORTABLE DRILLING APPARATUS

BACKGROUND OF THE INVENTION

1. Field of the Invention

This invention relates to a new and improved portable drilling apparatus. More particularly, the invention relates to a new lightweight portable drilling apparatus which is capable of being assembled and readily moved by helicopter.

2. Prior Art

The continuing need for new energy sources has resulted in an increase in exploration for petroleum in areas previously considered too inaccessible (such as remote mountainous areas) for conventional exploration equipment. Exploration in such remote areas has necessitated the development of new, more portable types of exploration equipment which could be used on uneven rock terrain.

Several attempts have been made to develop such exploration equipment, but the equipment developed to date has serious limitations. For example, equipment thus far used has been extremely heavy and difficult to move to remote areas. That which could be moved by helicopter generally required the use of larger, more expensive to operate helicopters. Attempts to lighten the equipment simply by using lighter metals, such as aluminum, could result in equipment that would be less rugged and more easily damaged during moving and drilling operations. On the other hand, attempts to strengthen the equipment by using strong rigid bases could make the apparatus difficult to control when drilling through uneven and rocky terrain, giving rise to misalignment.

It is an object of the invention, therefore, to provide a new and improved type of portable drilling apparatus.

It is another object of the invention to provide improved portable drilling equipment that can be easily and quickly assembled and disassembled.

It is also an object of the invention to provide a new lightweight portable drilling apparatus that can be easily moved by light lift helicopters.

It is a further object of the invention to provide such apparatus that are aerodynamically stable when being moved by helicopter.

It is an additional object of the invention to provide a new lightweight portable drilling apparatus that can be easily operated on uneven terrain.

It is still another object of the invention to provide lightweight portable drilling equipment that is substantially immune from vibration during operation.

It is a further object of the invention to provide new lightweight portable drilling equipment that can be operated by a single operator.

It is still a further object of the invention to provide new portable drilling apparatus that can operate efficiently at high elevations.

SUMMARY OF THE INVENTION

The above and other objects of the invention are realized in a specific illustrative embodiment of lightweight portable drilling apparatus which includes (1) a center vertically-oriented drilling tower equipped with a drill assembly, (2) a first module mountable on one side of the tower and including a first power source for supplying power to operate the drill assembly, and (3) a second module mountable on the other side of the tower and including either a second power source or auxiliary power equipment for also supplying power to operate the drill assembly. The two modules are either weighted about the same or are mountable on the tower to produce about the same moment of force with respect to the tower. With either arrangement, the drilling tower is at the center of gravity of the apparatus and this serves to greatly stabilize the apparatus so that heavy reinforcing structures are not needed. In addition, better control and balance is achieved during the drilling operation so as to give excellent drilling alignment. Also, since the modules may be readily mounted on and unmounted from the drilling tower for transporting separately, the apparatus may be lifted and carried by a light-lift helicopter one piece at a time.

In accordance with one aspect of the invention, the first and second modules include flexible tethers or straps by which the modules may be lifted and by which the modules are mounted in a type of suspension on each side of the drilling tower. The use of such straps reduces the amount of vibration which might otherwise be produced by the apparatus during operation.

In accordance with another aspect of the invention, each of the modules includes centrally located legs on which the modules may be rocked and pirouetted to facilitate moving the modules into place beside the drilling tower for mounting thereon.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
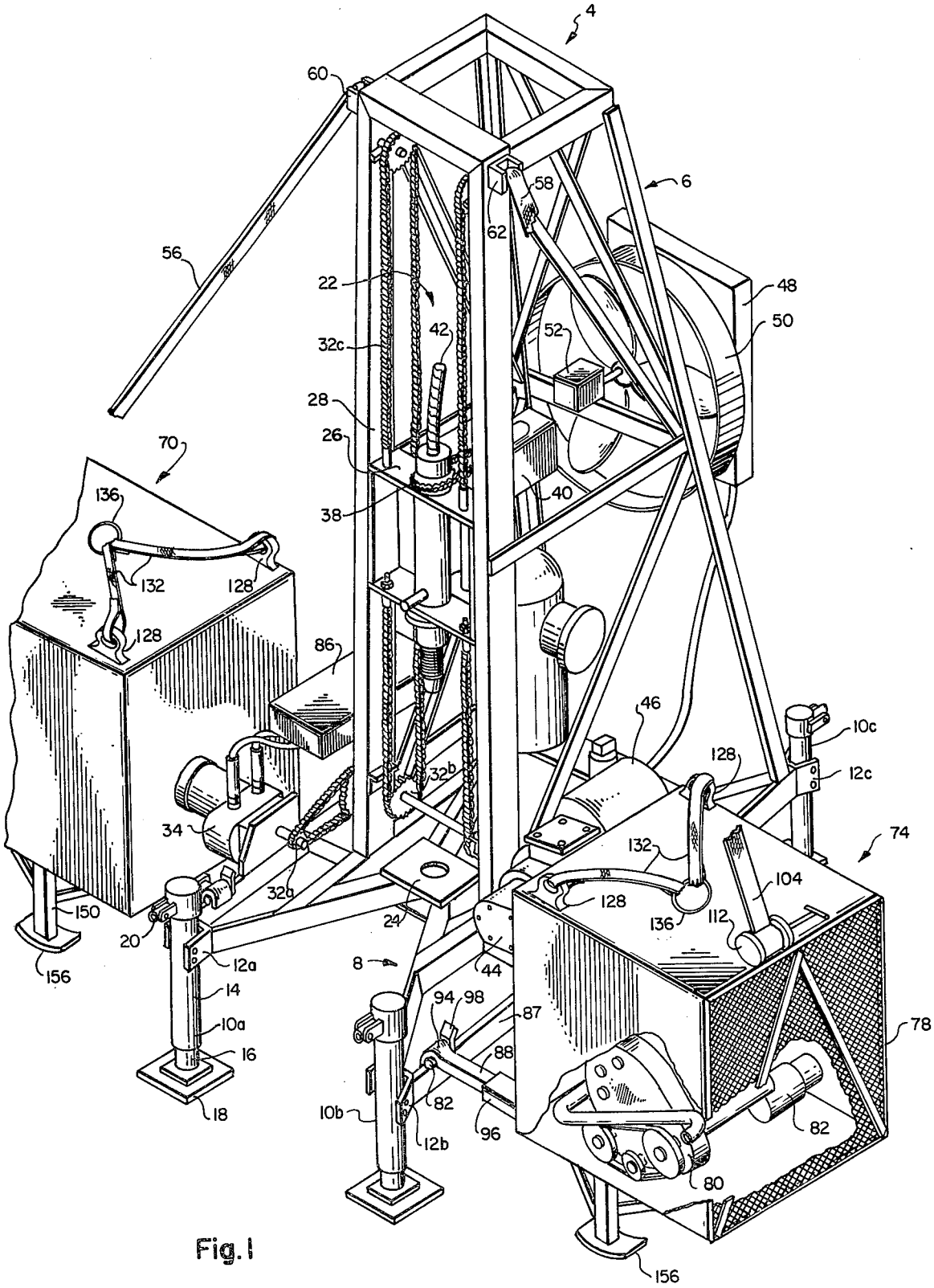
FIG. 1 is a perspective, partially fragmented view of drilling apparatus made in accordance with the principles of the present invention.
Figure 2:
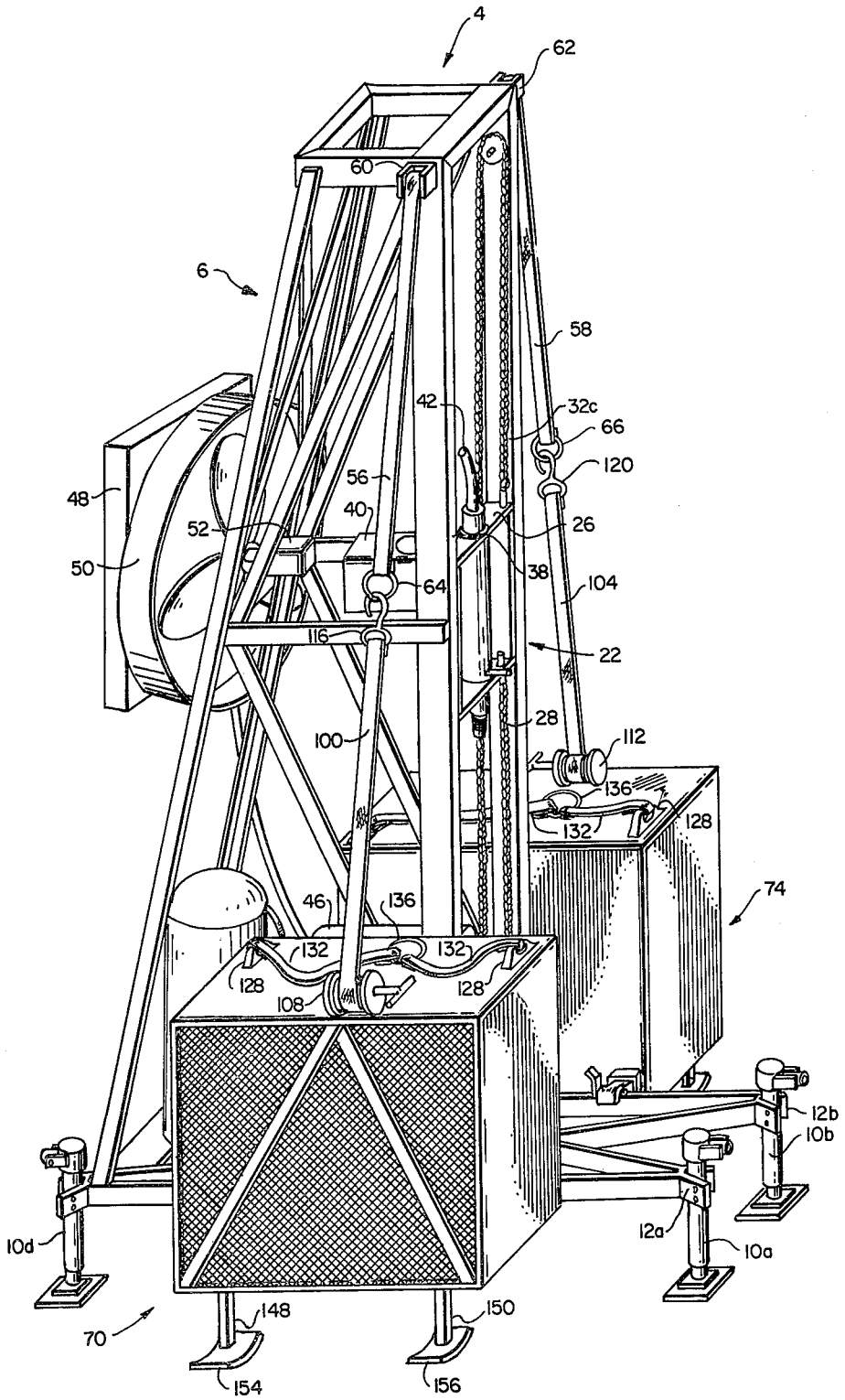
FIG. 2 is a side-oriented perspective view of the apparatus of FIG. 1.
Figure 3:
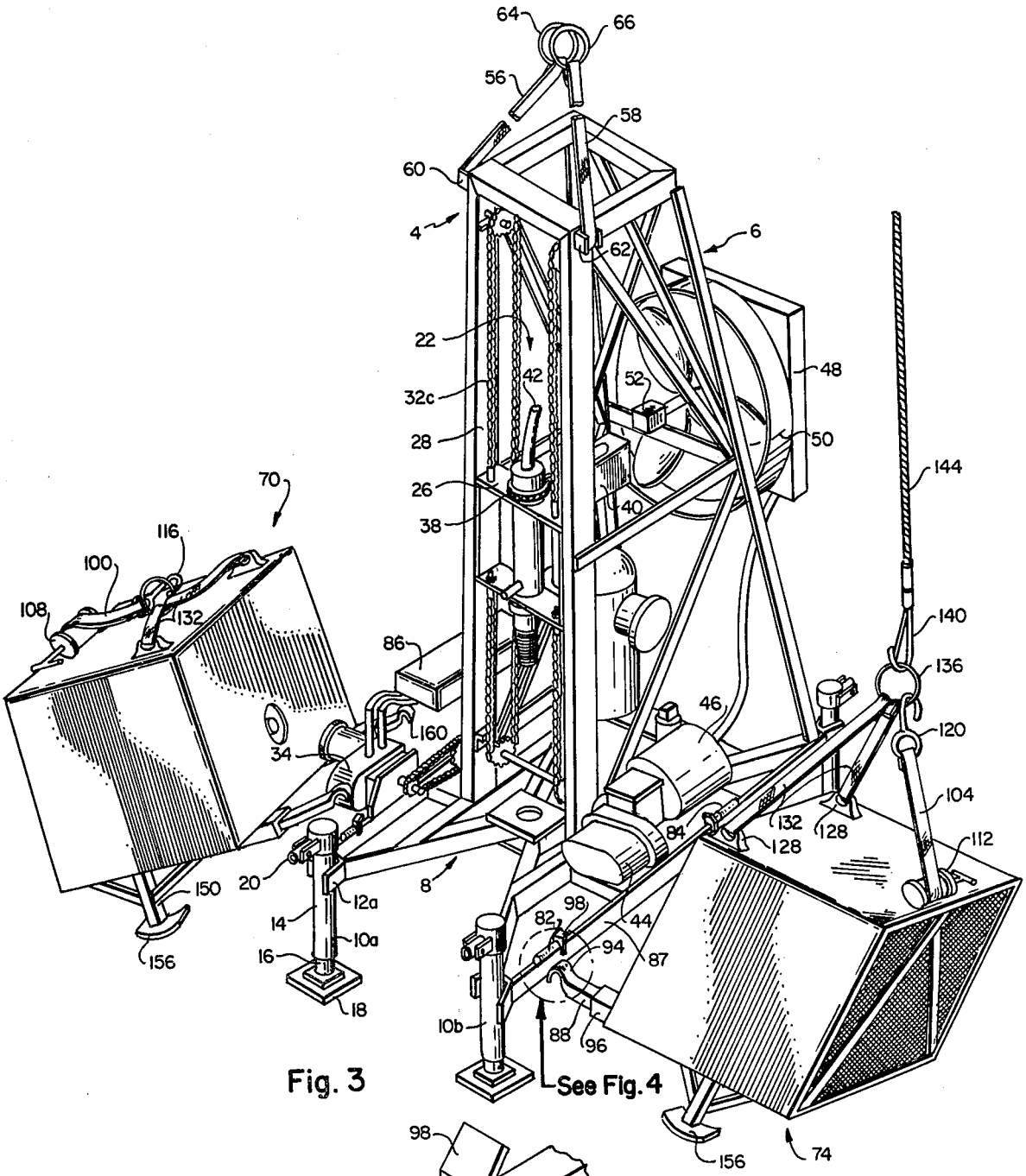
FIG. 3 shows the drilling apparatus disassembled into three separate units or modules.

Referring to FIGS. 1 through 3, there is shown a preferred embodiment of portable drilling apparatus made in accordance with the invention. This apparatus includes a center mast or drilling tower 4 comprised of a vertically-oriented frame 6 supported by a base 8. The base 8 is made of beams and braces and includes four adjustable length leveling legs 10*a* through 10*d* to enable maintaining the generally vertical orientation of the drilling tower 4 regardless of the terrain. Each leg is held in place by a corresponding U-shaped strut 12 formed at each corner of the base 8. Each leg is structured to operate as a hydraulic jack, having a sleeve 14 (see leg 10*a*), an extendable and retractable inner shank 16 with a pad 18 mounted on the lower end thereof, and a manually operable pump element 20 for causing the shank 16 to extend from the sleeve 14 when moved up and down. Of course, other types of structures, both mechanical and electrical, could be used for adjusting the length of legs 10*a* through 10*d*.

Carried in the frame 6 of the drilling tower 4 is a drill assembly 22 of conventional design including a slip box 24 mounted on the base 8 for guiding the drill stem, a drill head 26 for holding the drill stem, the drill head being movable up and down in guide slots 28 defined in the frame 6, a drive linkage 32*a*, 32*b* and 32*c* powered by hydraulic motor 34 mounted on the base 8 for raising and lowering the drill head 26, and a gear linkage 38 powered by another hydraulic motor 40 for rotating the drill stem. Pneumatic power for effecting vibration of the drill bit is supplied via line 42 from a compressor 44 mounted on the base 8. The compressor is powered by still another hydraulic motor 46 mounted on the compressor 44.

The compressor 44 is cooled by a coolant which is circulated through a radiator 48 which, together with a fan 50, is mounted on the frame 6 near the top thereof. The fan 50 is powered by still another hydraulic motor 52 to draw air through the radiator 48 to cool the coolant which is then delivered to the compressor 44 to cool the compressor. The positioning of the fan 50 and radiator 48 near the top of the drilling tower stabilizes the tower aerodynamically when it is being lifted and moved through the air by helicopter. The fan and radiator positioned on the drilling tower 4 create a drag when the tower is being moved through the air and this tends to prevent the tower from twisting as is the case with other portable drill rigs when they are moved by helicopter.

As can best be seen in FIG. 3, the drilling tower 4 includes a pair of flexible straps 56 and 58 joined at one end to brackets 60 and 62 mounted at the top of the tower, and attached to respective rings 64 and 66 at the other end. When the drilling tower 4 is to be moved by helicopter, a helicopter lifting hook is placed through the rings 64 and 66 and then the tower is lifted and carried by the straps 56 and 58.

The portable drilling apparatus embodiment of the drawings also includes a pair of modules 70 and 74 for holding engines, hydraulic pumps and auxiliary power equipment for supplying power to operate the drill assembly 22. The modules are mountable on opposite sides of the drilling tower 4 (as best seen in FIGS. 1 and 2) and demountable therefrom (as best seen in FIG. 3). The placement may take a variety of configurations so long as the weight (or the moment of force) of each module is about the same. By mounting the two modules on opposite sides of the drilling tower, the entire drilling apparatus is stabilized for the drilling operation. Other prior art portable drilling equipments typically position the drilling mast at one end of the equipment so that upon encountering difficulty in the drilling operation, the equipment may be caused to pivot upwardly about the other end of the equipment. This may result in the bending or breaking of the drill stem or in the stem becoming stuck in the drill hole. Also, such pivoting may cause the sides of the drill hole to cave in. This problem is avoided with the arrangement of modules 70 and 74 on opposite sides of the drilling tower 4. The moments of force of the two modules can be equalized either by adding dead weight to the lighter of the two, or by mounting the lighter of the two a greater distance from the drilling tower than the heavier module.

Each module includes a box-like frame or housing 78 (see module 74) in which is mounted an engine 80 which powers a hydraulic pump 82. (The module 70 similarly includes an engine which powers a hydraulic pump.) The hydraulic pumps are coupled by way of hoses to one or more manifolds 86 mounted on the base 8 of the drilling tower 4 for delivering pressurized hydraulic fluid thereto. From there, the hydraulic fluid is delivered to the hydraulic motor 34 which, as previously discussed, powers drive linkage 32*a*, 32*b* and 32*c* to raise and lower the drill head 26, to the hydraulic motor 40 which powers gear linkage 38 to rotate the drill stem, to the hydraulic motor 52 for powering the fan 50, and to the hydraulic motor 46 which powers the compressor 44.

In an alternative arrangement for the modules 70 and 74, an engine and a hydraulic pump driven by the engine are mounted in module 70, and a second engine and the compressor 44 driven by the second engine are mounted in module 74. In another alternative arrangement, a single but fairly powerful engine is mounted in module 70, and a hydraulic pump and the compressor 44, both powered by the engine are mounted in module 74. In each of the two alternative arrangements for the modules 70 and 74, the moments of force of the two modules, with respect to the drilling tower 4, are made to be substantially the same.

The modules are pivotally mounted on the drilling tower 4 and, in particular, on the base 8 of the tower by way of pivotal couplings, each composed of a pair of generally cylindrical lips such as lips 82 and 84 formed on a beam 87 of the base 8 (see FIG. 3), and a pair of extendable and retractable arms projecting out from the bottom of a module, such as arm 88, for engaging and resting on the lips. Each arm includes an arcuate end section, such as section 94, which mates with and fits over a corresponding cylindrical lip (see FIG. 4). Each arm also fits telescopically in a corresponding sleeve, such as sleeve 96, into which the arm may be slid and from which the arm may be pulled to vary the length of the arm. To guide the arcuate end sections onto the corresponding lips, guide tabs, such as guide tab 98, project upwardly and away from one end of the respective lips. When the arcuate end sections of the arms of a module are placed onto respective lips, the module may pivot about the lips in a generally vertical direction.

The modules 70 and 74 are held in place on each side of the drilling tower 4 by flexible tethers or straps 100 and 104 (FIG. 2), which are joined at one end to respective winches 108 and 112 mounted on top of the modules 70 and 74, and which are joined at the other end to hooks 116 and 120 which, in turn, are coupled to the rings 64 and 66 of the drilling tower straps 56 and 58. The winches are manually operable to lengthen or shorten the straps holding the modules in place.

Also included on top of each of the modules 70 and 74 are large, spaced-apart eyelets 128 to which are coupled flexible straps 132. A ring 136 is joined to the ends of the straps 132. The eyelets 128, straps 132 and ring 136 are used in conjunction with the corresponding winch, strap and hook, such as winch 112, strap 104 and hook 120 (FIG. 3), to lift and carry the modules. The hook 120 is simply placed through the ring 136 and then the winch 112 is adjusted so that the strap 104 is about the same length as the straps 132. A hook 140 and lift line 144 (FIG. 3) from a helicopter may then be joined to the ring 136 to lift the module.

It should be noted that the same straps used for lifting the drilling tower 4 (straps 56 and 58) and for lifting the modules (straps 100 and 104) are also used for mounting and suspending the modules from the drilling tower. The use of flexible straps to mount the modules on the drilling tower serves to dampen the otherwise harmful effects of vibration. That is, some of the vibration produced by the apparatus which might otherwise be transmitted between the drilling tower and modules is absorbed in the straps.

To facilitate maneuvering the modules into position where they may be mounted onto the drilling tower, a pair of legs are provided to extend downwardly from underneath the modules (such as legs 148 and 150 of module 70 in FIG. 2). The legs are centrally located underneath the modules and include feet, such as feet 154 and 156, which are rounded on the bottom to enable rocking and pirouetting of the modules into position.

The modules are mounted on the drilling tower, after being deposited by helicopter or other carrying method as near as possible to the tower, by moving the modules into position with the arms of the module adjacent to the corresponding cylindrical lips. The modules are designed so that one person can readily maneuver the modules into position for mounting. The arms of the module may be extended so that the arcuate end sections of the arms rest on the corresponding lips. The module support strap, such as strap 100 (FIG. 2), is then extended by operation of the winch 108 until the hook 116 can be coupled to the ring 64 of the tower strap 56. The winch 108 is then operated to retract the strap 100 and raise the module into position on the side of the tower. As the module is raised into position, the arms of the module slide back into the corresponding sleeves (such as arms 160 of module 70 [FIG. 3]) under the weight of the module.

Figure 4:
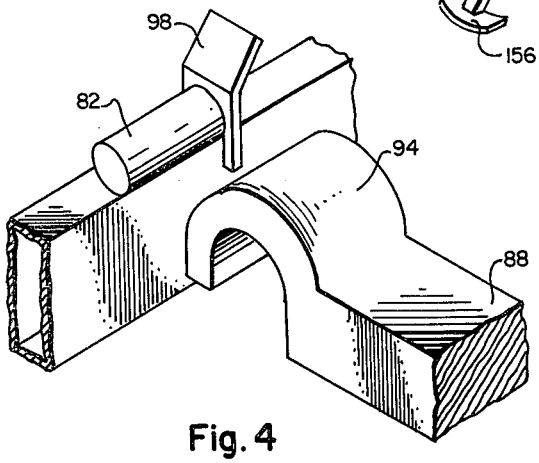
FIG. 4 is a perspective fragmented, view of the pivotal coupling used to mount the side modules on the drilling tower.

To briefly recapitulate what is shown in the various drawings used to describe the drilling apparatus thus far, FIG. 1 shows the assembled apparatus from a front, perspective, partially fragmented view. FIG. 2 shows the assembled apparatus from a side, perspective view. FIG. 3 shows the apparatus in disassembled form, with the modules 70 and 74 disengaged from the drilling tower 4. FIG. 4 shows a fragmented view of the pivotal coupling used for mounting the modules on the drilling tower.

Figure 5:
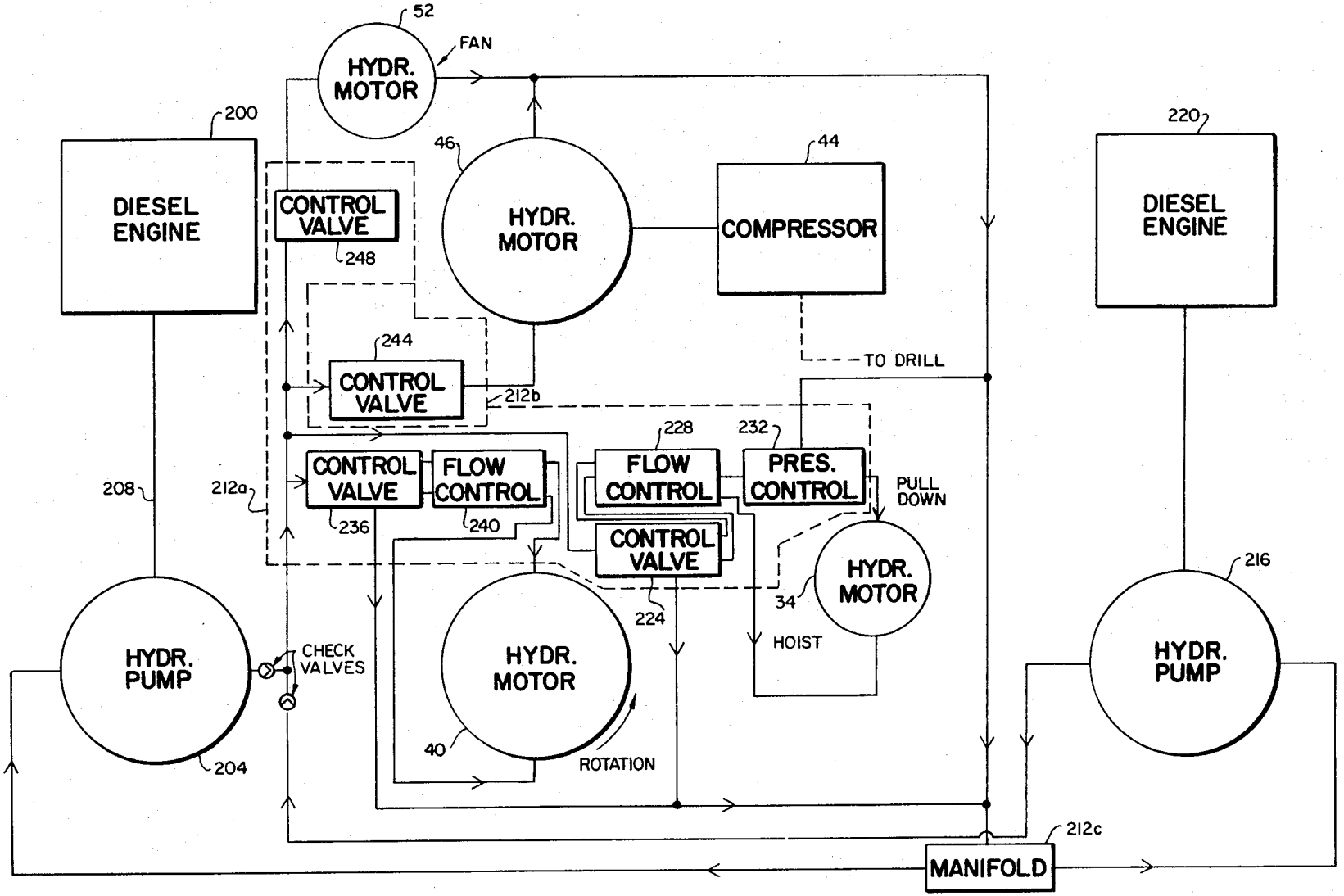
FIG. 5 is a schematic showing of one embodiment of the power equipment for use with the drilling apparatus of the present invention.

FIG. 5 is a schematic drawing illustrating a preferred hydraulic power circuit used in powering the drill assembly 22 (FIG. 1). Flow of the hydraulic fluid is shown by the directional arrows. A diesel or gasoline engine 200 operates a hydraulic pump 204 by a coupling spline 208 to cause the pump to pump hydraulic fluid via a check valve to manifolds 212*a* and 212*b*. Similarly, another hydraulic pump 216 is operated by a diesel or gasoline engine 220 to supply hydraulic fluid via a check valve to manifolds 212*a* and 212*b*. From the manifold, the hydraulic fluid flows under pressure to the various hydraulic motors used in powering the drilling apparatus.

Hydraulic fluid flows under pressure to the hydraulic motor 34 which effects the raising and lowering of the drill head 26. This motor is operated under control of valves 224, 228 and 232. In particular, control valve 224 determines the direction of rotation of the motor 34 by directing hydraulic fluid to a selected one of two output lines which fluid then flows through flow control valve 228 to either the pressure control valve 232 and to the motor 34 to cause it to pull down the drill head, or directly to the motor 34 to cause it to hoist the drill head. From the motor 34, the hydraulic fluid flows back through the flow control valve 228 and control valve 224 to a manifold 212*c*. The control valve 224 can also be operated to prevent operation of the motor 34 all together. Flow control valve 228 controls the speed at which the hydraulic motor 34 operates and pressure control valve 232 regulates the "pull down" pressure applied to the drill head 26.

Manifold 212*a* also supplies hydraulic fluid to the hydraulic motor 40 which, under control of control valve 236 and flow control valve 240, effects the rotation of the drill system, and to hydraulic motor 52 which, under control of control valve 248, powers the fan used in cooling the compressor. Manifold 212*b* supplies hydraulic fluid to the hydraulic motor 46 under control of control valve 244 to effect operation of the compressor 44 needed for vibration of the drilling bit. The particular hydraulic power schematic shown in FIG. 5 utilizes conventional hydraulic system techniques.

Figure 6:
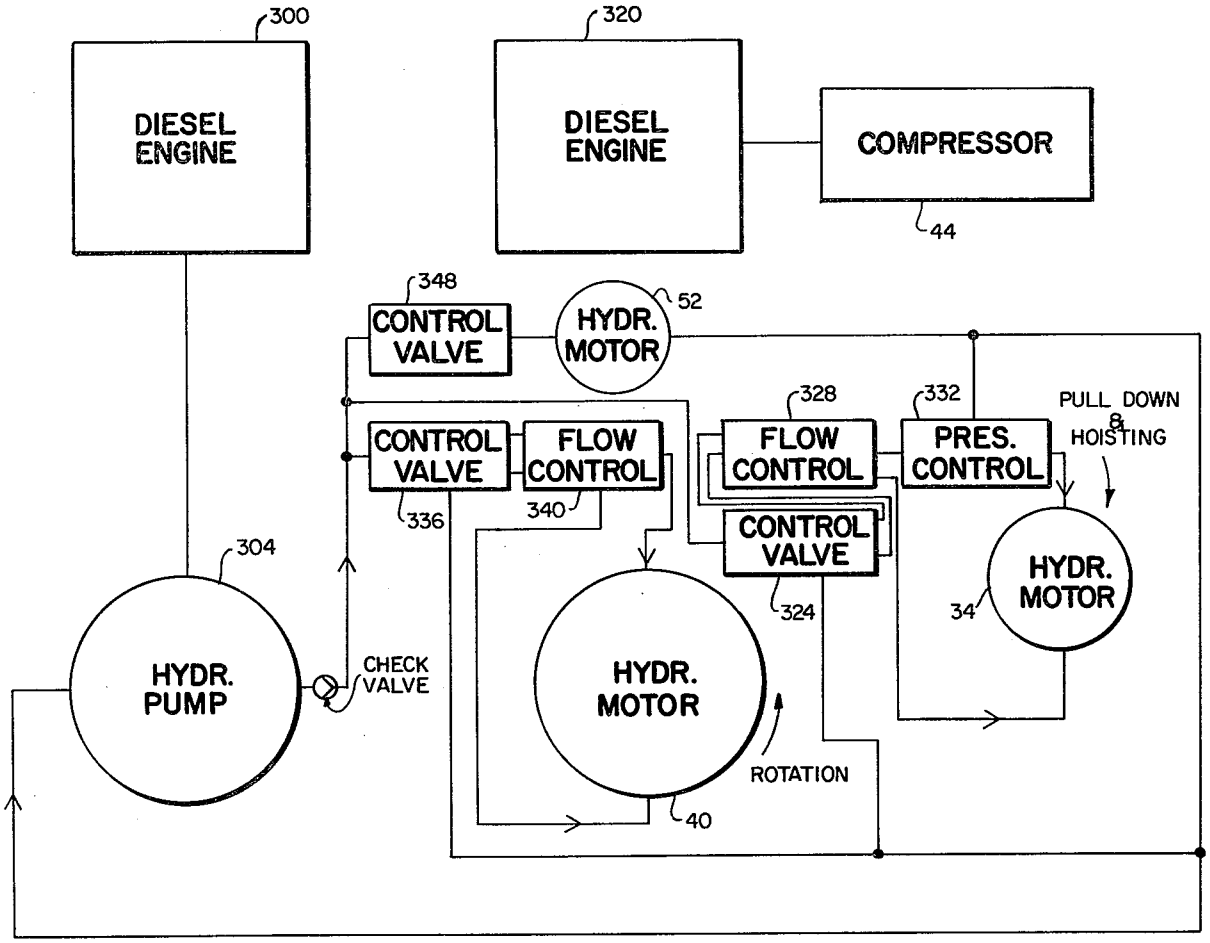
FIG. 6 is a schematic showing of an alternative embodiment of power equipment.

To reduce weight and give more efficient operation, it is sometimes desirable to utilize a single direct drive diesel or gasoline engine to power the compressor 44. A hydraulic power circuit for doing this is shown in FIG. 6. In this arrangement, a diesel engine 300 operates hydraulic pump 304 which supplies hydraulic fluid under pressure to the hydraulic motor 34 which effects the raising and lowering of the drill head. As before, the motor is controlled by control valve 324, flow control valve 328, and pressure control valve 332. The pump 304 further supplies fluid to the hydraulic motor 40, which effects the rotation of the drill stem, and to the hydraulic motor 52, which powers the fan 50. Diesel engine 320 directly powers the compressor 44.

The center drilling tower 4 may be constructed in any desired manner and with any suitable material, but one advantage of the invention is realized when the tower is made from strong but lightweight metals, such as aluminum, titanium, magnesium or carbon fiber. As a preferred embodiment, the center drilling tower 4 comprises four upright metal structural members forming a box-like frame 6 joined at the top by metal structural members and at the bottom by the base 8 to which is attached the slip box 24 and the four adjustable leveling legs 10*a*–10*d* located generally at the four corners of the base. The slip box 24 at the base of the tower 4 may be of any conventional construction. The mechanism for raising and lowering the drill head 26 may be of any type, but is preferably a combination of sprockets and chains as shown in FIG. 1, although other suitable apparatus, such as gears, belts, hydraulic or pneumatic cylinders, etc., could also be utilized.

The two modules may be of any suitable construction so long as they can be detachably coupled to the base of the tower 4. Preferably, the modules each comprise a metal box-like frame open on the sides or ends as needed for ventilation. A screen and fan may be located at the end or side to assist ventilation. Advantageously, the modules are preferably prepared from strong but lightweight metal, such as aluminum, titanium, magnesium or carbon fiber.

The straps or cables used to support and lift the modules may be any suitable structure such as nylon straps, metal cables, steel straps, leather straps, etc.

The engines, pumps and compressor units may also be of any suitable type as long as they produce the necessary power needed for operating the drill assembly 22. Suitable engines comprise lightweight, fairly high powered gasoline, diesel, or other type engines. Turbocharged gasoline or diesel engines are especially desirable for high altitude operation.

A significant advantage of the portable drilling apparatus of the present invention is that it may be disassembled quickly and easily (without the use of a helicopter), moved by helicopter from one location to another, and quickly assembled again (also without the use of the helicopter). The disassembly is easily accomplished by releasing the tension on the straps joining the modules 70 and 74 to the drilling tower 4 and then detaching the pivotal couplings by which the modules are mounted on the tower. The power equipment in the modules is then disconnected from the manifolds on the drilling tower, and the straps by which the modules are suspended from the tower are disconnected. The modules are then laid back on the ground, being supported by the legs at the bottom thereof. The drilling tower is then moved by "hooking" the tower straps to the helicopter cable. The modules are next moved by joining the straps which are connected to the eyelets on the top of the modules to the corresponding strap connected to the winch, and these are "hooked" to the cable from the helicopter for transportation to the new location. The tower and two modules are then easily reassembled as earlier described, and the power equipment connected to the drill assembly.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A portable drilling apparatus comprising a center generally vertically-oriented drilling tower for carrying a drill assembly, a first module mounted on and demountable from one side of the drilling tower and including a first power means for supplying power to operate the drill assembly, a second module mountable on and demountable from the other side of the drilling tower and including a second power means for supplying power to assist in the operation of the drill assembly, and one or more hydraulic motors mounted on the drilling tower and a compressor also mounted on the drilling tower and driven by one of the hydraulic motors, said hydraulic motors and compressor being coupled to the drill assembly to operate the assembly, and wherein said first power means comprises an engine, and a hydraulic pump driven by the engine and coupled to the hydraulic motors, and wherein said second power means comprises a second engine and a second hydraulic pump driven by the second engine and coupled to the hydraulic motors.

2. A drilling apparatus as in claim 1 further including manifold means coupled to the two hydraulic pumps for receiving hydraulic fluid therefrom and for delivering the fluid to the hydraulic motors.

3. A portable drilling apparatus comprising a center generally vertically-oriented drilling tower for carrying a drill assembly, a first module mounted on and demountable from one side of the drilling tower and including a first power means for supplying power to operate the drill assembly, a second module mountable on and demountable from the other side of the drilling tower and including a second power means for supplying power to assist in the operation of the drill assembly, and one or more hydraulic motors mounted on the drilling tower and coupled to the drill assembly to operate the assembly, and wherein said first power means comprises an engine, and wherein said second power means comprises a compressor said compressor being coupled to the drill assembly.

4. A drilling apparatus as in claim 3 wherein said second power means further comprises a hydraulic pump driven by the engine and coupled to the hydraulic motors.

5. A drilling apparatus as in claim 3 wherein said first power means further includes a hydraulic pump driven by the engine and coupled to the hydraulic motors, and wherein said second power means comprises a second engine for driving the compressor.

6. A portable drilling apparatus comprising a center generally vertically-oriented drilling tower for carrying a drill assembly, a first module mounted on and demountable from one side of the drilling tower and including a first power means for supplying power to operate the drill assembly, a second module mountable on and demountable from the other side of the drilling tower and including a second power means for supplying power to assist in the operation of the drill assembly, and a compressor coupled to the drill assembly to vibrate a part of the assembly, a radiator through which compressor cooling fluid circulates for cooling, and a fan coupled to one of the power means by which the fan is caused to rotate for forcing air through and about the radiator, said radiator and fan being mounted adjacent to one another on one side of the drilling tower.

7. A drilling apparatus as in claim 6 wherein said radiator and fan are mounted on a side of the drilling tower other than the sides on which the first and second modules are mountable.

8. A portable drilling apparatus comprising a center generally vertically-oriented drilling tower for carrying a drill assembly, a first module mounted on and demountable from one side of the drilling tower and including a first power means for supplying power to operate the drill assembly, a second module mountable on and demountable from the other side of the drilling tower and including a second power means for supplying power to assist in the operation of the drill assembly, and wherein said modules are pivotally mounted on the drilling tower to enable raising and lowering the modules while mounted on the drilling tower.

9. A drilling apparatus as in claim 8 wherein each module further includes one or more legs centrally located under said each module to allow rocking and pirouetting of the module.

10. A drilling apparatus as in claim 9 wherein each leg includes a foot on the lower end thereof, the bottom of said foot being generally rounded.

11. A drilling apparatus as in claim 8 wherein the drilling tower includes pivot support elements on said one side and said other side of the drilling tower, and wherein each of the modules includes elongate arms projecting from one side of said each module to engage and rest on respective support elements in a pivotal relationship, said drilling apparatus further including suspension means interconnecting each module to the drilling tower at a location above the pivot support elements for suspending the modules from the tower.

12. A drilling apparatus as in claim 11 wherein each elongate arm is extendible from and retractable into the corresponding module.

13. A drilling apparatus as in claim 11 wherein each pivot support element comprises a generally cylindrical lip, and wherein each elongate arm comprises an arcuate end section for engaging and pivotally resting on a corresponding lip.

14. A drilling apparatus as in claim 13 wherein each pivot support element further comprises a guide tab which extends upwardly and away from one end of a respective lip to serve to guide a corresponding arcuate end section onto the lip from which guide tab extends.

15. A drilling apparatus as in claim 11 wherein the suspension means comprise flexible tethers.

16. A drilling apparatus as in claim 15 further including adjustment means selectively lengthening or shortening the tethers.

17. A drilling apparatus as in claim 16 wherein said adjustment means comprises a first and second winch means mounted on said first and second modules respectively and coupled to tethers which are in turn attached to the drilling tower.

* * * * *